US009922786B2

(12) United States Patent
Oshima

(10) Patent No.: US 9,922,786 B2
(45) Date of Patent: Mar. 20, 2018

(54) PRESSURE SWITCH

(71) Applicant: SMC Corporation, Chiyoda-ku (JP)

(72) Inventor: Yuta Oshima, Moriya (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 15/155,174

(22) Filed: May 16, 2016

(65) Prior Publication Data

US 2016/0365207 A1 Dec. 15, 2016

(30) Foreign Application Priority Data

Jun. 9, 2015 (JP) ..... 2015-116676

(51) Int. Cl.
*H01H 35/26* (2006.01)
*H01H 35/24* (2006.01)

(52) U.S. Cl.
CPC ..... *H01H 35/26* (2013.01); *H01H 35/24* (2013.01)

(58) Field of Classification Search
CPC ..... H01H 35/26; H01H 35/24
USPC ..... 200/81.5
See application file for complete search history.

(56) References Cited

U.S. PATENT DOCUMENTS

2008/0135395 A1* 6/2008 Kawakami ..... G01L 19/0038 200/81 R
2015/0136576 A1* 5/2015 Chu ..... H02B 1/26 200/5 A

FOREIGN PATENT DOCUMENTS

JP 7-37473 2/1995

* cited by examiner

*Primary Examiner* — Edwin A. Leon
*Assistant Examiner* — Iman Malakooti
(74) *Attorney, Agent, or Firm* — Oblon, McClelland, Maier & Neustadt, L.L.P.

(57) ABSTRACT

A pressure switch is equipped with a pressure sensor, a housing that houses the pressure sensor, an annular seal member arranged in a hole of the housing and which is interposed between the pressure sensor and the housing, and a pressing member that is fixed to the housing. The pressing member includes a base section that faces the seal member, and engagement arms that extend from the base section, are elastically deformable, and engage with the housing.

4 Claims, 3 Drawing Sheets

PRESSURE SWITCH

CROSS-REFERENCE TO RELATED APPLICATION

This application is based upon and claims the benefit of priority from Japanese Patent Application No. 2015-116676 filed on Jun. 9, 2015, the contents of which are incorporated herein by reference.

BACKGROUND OF THE INVENTION

Field of the Invention

The present invention relates to a pressure switch including a pressure sensor, which outputs an output signal based on a pressure value detected by the pressure sensor.

Description of the Related Art

Heretofore, for example, by supplying a negative pressure fluid with respect to a suction transport means such as a suction pad or the like, transporting of a workpiece to a predetermined position is carried out while the workpiece is attracted under suction by the suction pad. In this case, a pressure switch is used for confirming whether or not the workpiece has reliably been attracted, by the pressure value of the negative pressure fluid that is supplied to the suction pad reaching a predetermined pressure. With such a pressure switch, in general, a semiconductor pressure sensor is used that functions as a pressure sensor, and based on a resistance value, which is changed by a pressure applied to the pressure sensor, a pressure of a fluid is detected, and it is judged whether a workpiece is attracted, and a detection signal is output therefor when the pressure value detected by the pressure sensor matches with a preset pressure value that has been set beforehand.

To such a pressure switch, for example, a vacuum pipe is connected detachably through a tube joint to a pressure inlet port of a housing in which the pressure sensor is housed, and a negative pressure fluid that flows through the vacuum pipe is introduced into the housing, whereby the pressure of the negative pressure fluid is detected (for example, refer to Japanese Laid-Open Patent Publication No. 07-037473). Further, though not disclosed in Japanese Laid-Open Patent Publication No. 07-037473, generally, as a seal structure for maintaining airtightness between the pressure sensor and the housing, a structure is adopted in which an O-ring is arranged between the pressure sensor and the housing.

SUMMARY OF THE INVENTION

As conventional sealing structures that may be provided in the pressure switch, the following arrangements (1) through (3) are known.

(1) A sealing structure in which an O-ring simply is sandwiched between the pressure sensor and the housing.

(2) A sealing structure in which a metal washer or the like is fixed by subjecting a metallic housing to plastic deformation (caulking, rolling caulking, etc.), and an O-ring, which is disposed between the pressure sensor and the housing, is pressed by the fixed metal washer or the like.

(3) A sealing structure in which a toothed washer or the like is deformed and fixed to the housing, and an O-ring, which is disposed between the pressure sensor and the housing, is pressed by the fixed toothed washer or the like.

However, with the aforementioned sealing structure (1), a seal cannot be provided in the case that the pressure sensor moves in the vertical direction, and further, there is a possibility for the O-ring to protrude when a large gap is formed and the pressure is received. With the aforementioned sealing structure (2), in order to implement the method of construction using plastic deformation such as a caulking process or a rolling caulking process or the like, a dedicated caulking apparatus or the like is required, there is a need for a large manufacturing load, and further since plastic deformation is used, the housing is limited to being made of metal. With the aforementioned sealing structure (3), the housing to which the toothed washer or the like is fixed is limited to being made of metal for reasons of strength or structural integrity.

The present invention has been devised taking into consideration these types of problems, and has the object of providing a pressure switch, in which the constituent material of the housing is not limited to metal, and in which a configuration for preventing protrusion of a seal member can be assembled easily with a small load, without the need for using specialized equipment.

To achieve the aforementioned object, a pressure switch according to the present invention is characterized by comprising a pressure sensor, a housing configured to include a hole in which a portion of the pressure sensor is inserted, and to house the pressure sensor, an annular seal member arranged in the hole and being interposed between the pressure sensor and the housing, and a pressing member including a base section configured to face the seal member, and an elastically deformable engagement arm extending from the base section, and configured to engage with the housing.

In accordance with the pressure switch, which is constructed in the manner described above, the pressing member includes the elastically deformable engagement arm, and the pressing member is fixed by engagement of the engagement arm with the housing. Therefore, there is no need to utilize dedicated equipment such as a caulking apparatus or the like, and it is possible to carry out assembly of the pressing member onto the housing easily and with a small load. Further, when the pressing member is assembled, since plastic deformation of a metallic member by way of caulking or the like is not used, a material other than metal (a resin or the like) can be applied to the housing, and the degree of freedom in selecting the material therefor can be enhanced. In addition, since the sealing property is maintained even if the pressure sensor moves in a vertical direction, the degree of freedom in design also is increased.

In the above-described pressure switch, a first engagement member may be disposed on the engagement arm, the housing may include a tubular wall configured to surround the hole, and a second engagement member may be disposed on an outer circumference of the tubular wall, and configured to engage with the first engagement member.

In accordance with this configuration, with a simple structure, the pressing member can be fixed firmly with respect to the housing.

In the above-described pressure switch, one of the first engagement member and the second engagement member may be in form of a hole or a groove, and another of the first engagement member and the second engagement member may be in form of a projection that is inserted into the hole or the groove.

In accordance with this configuration, the pressing member can be fixed with an appropriate fixing force with respect to the housing.

In the above-described pressure switch, the hole may include in one end thereof a first opening into which the portion of the pressure sensor is inserted, and may include a second opening in another end thereof on an opposite side from the one end, the projection may be disposed on the outer circumference of the tubular wall, and on the projection, a tapered guide may be formed, which is inclined so as to move away from an axis of the hole, from a side of the first opening toward a side of the second opening.

In accordance with this configuration, when the pressing member is assembled with respect to the housing, by a tapering action of the tapered guide, outward elastic deformation of the engagement arm of the pressing member is promoted, whereby the engagement arm can easily overcome the projection. Therefore, assembly of the pressing member can be accomplished more easily and smoothly.

In the above-described pressure switch, a through hole in which the portion of the pressure sensor is inserted may be provided in the base section, and a pair of engagement arms may be provided on both sides of the base section.

In accordance with this configuration, the pressing member can be fixed more stably with respect to the housing, and the functions of the pressing member can be exhibited more suitably.

According to the pressure switch of the present invention, a configuration for preventing protrusion of a seal member can be assembled easily with a small load, without the need for using specialized equipment, and together therewith, the constituent material of the housing is not limited to a metal.

The above and other objects, features and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

A preferred embodiment of a pressure switch according to the present invention will be presented and described in detail below with reference to the accompanying drawings.

Figure 1:
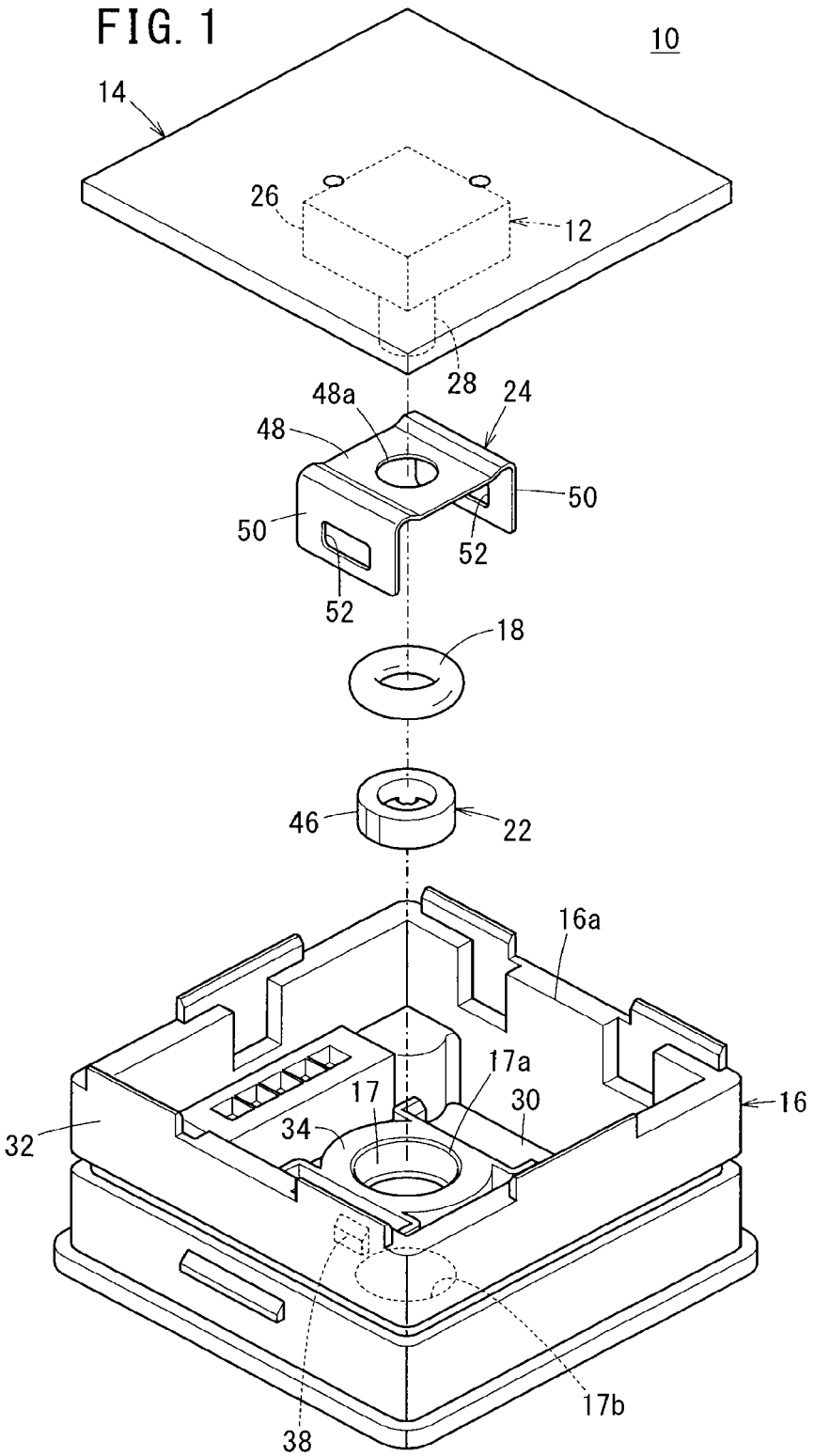
FIG. 1 is an exploded perspective view of a pressure switch according to an embodiment of the present invention.
Figure 2:
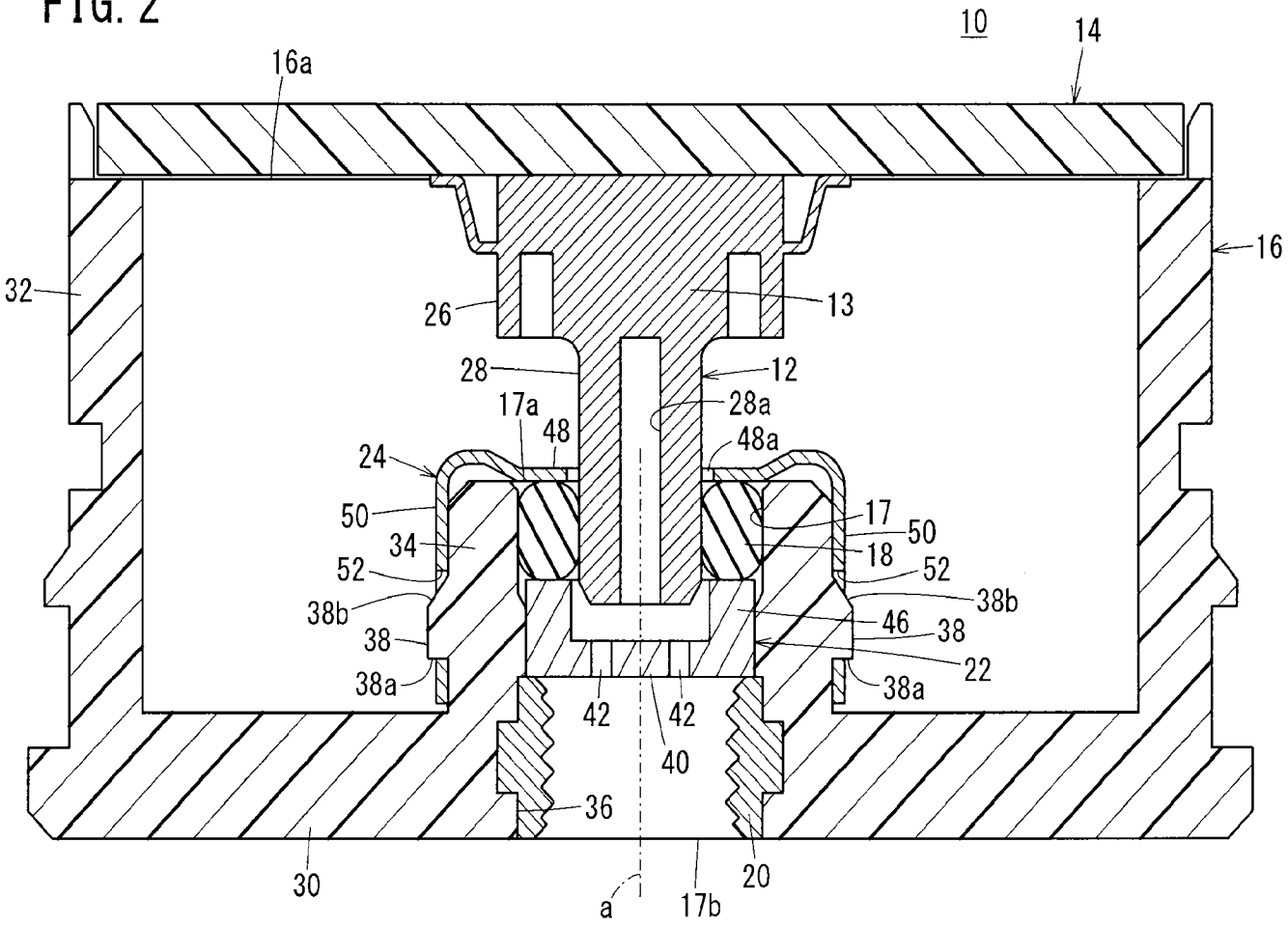
FIG. 2 is a cross-sectional view of the pressure switch shown in FIG. 1.

A pressure switch 10 shown in FIGS. 1 and 2 includes a pressure sensor 12 that detects the pressure of a pressure fluid, and is a device for outputting an output signal based on a pressure value that is detected by the pressure sensor 12. The pressure fluid, for example, is negative pressure air or positive pressure (compressed) air. Alternatively, the pressure fluid may be a liquid.

The pressure switch 10 according to the present embodiment is equipped with a circuit board 14 (control board), the pressure sensor 12 connected to the circuit board 14, a box-shaped housing 16 that houses the pressure sensor 12, a seal member 18 that is interposed between the pressure sensor 12 and the housing 16, a pipe joint 20 (see FIG. 2), which is attached to a pressure inlet port 36 of the housing 16, a protective member 22 arranged in a hole 17 of the housing 16, and a pressing member 24 that is fixed to the housing 16.

The pressure sensor 12 is connected electrically to the circuit board 14. Further, a non-illustrated display and an operating button are connected electrically to the circuit board 14. An opening 16*a* of the housing 16 is closed by the circuit board 14, whereby the housing 16 is sealed hermetically.

The pressure sensor 12 is constituted from a semiconductor pressure sensor, and based on a resistance value, which is changed by a pressure of the pressure fluid being applied with respect to the pressure sensor 12, the pressure of the pressure fluid can be detected.

More specifically, as shown in FIG. 2, the pressure sensor 12 includes a base member 26 that is mounted on the circuit board 14, and a tubular section 28 that projects from the base member 26. A detection hole 28*a* is formed in the tubular section 28 and the pressure fluid flows in the detection hole 28*a*. A vertical cross section of the pressure sensor 12 overall is formed substantially in a T-shape. Although not illustrated in FIG. 2, the pressure sensor 12, in greater detail, is made up from a detector (sensor main body), which is an electronic component, and a sensor holder 13 that constitutes the outer shape of the pressure sensor 12. Illustration of the detector is omitted in FIG. 2.

The housing 16 includes a bottom portion 30 in which the pressure inlet port 36 is formed, a side wall 32 that is erected from a circumferential edge part of the bottom portion 30, and a tubular wall 34 that projects on the inside of the side wall 32 toward the interior of the housing 16 (toward the side of the circuit board 14) from the bottom portion 30. Although the illustrated example of the housing 16 is substantially rectangular as viewed in plan, the shape of the housing 16 may be of another shape, such as a circular shape or the like as viewed in plan.

Further, the housing 16 includes the hole 17 therein. The hole 17 is a through hole made up from a hollow portion of the tubular wall 34 and the pressure inlet port 36. The hole 17 includes in one end thereof a first opening 17*a* into which a portion (the tubular section 28) of the pressure sensor 12 is inserted, and includes a second opening 17*b* in another end thereof on an opposite side from the one end.

The opening 16*a* of the housing 16 is formed by an upper edge part of the side wall 32, and the opening 16*a* of the housing 16 is closed by attaching the circuit board 14 to the upper edge part of the side wall 32.

The tubular section 28 of the pressure sensor 12 is inserted into the hollow portion of the tubular wall 34. Plural engagement projections 38 (second engagement members) are provided on the outer circumference of the tubular wall 34. According to the present embodiment, the engagement projections 38 are disposed at locations on mutually opposite sides on the outer circumferential surface of the tubular wall 34. The engagement projections 38 include latching surfaces 38*a* that catch on the pressing member 24, and tapered guides 38*b* that are formed on opposite sides from the latching surfaces 38*a* (more toward the side of the first opening 17*a* than the latching surfaces 38*a*) in relation to a direction along an axial line a of the hole 17. In the illustrated example, the latching surfaces 38*a* are defined by planes perpendicular to the axial line a of the hole 17.

The tapered guides 38*b* are inclined away from the axial line a of the hole 17, in a direction toward the side of the second opening 17*b* from the first opening 17*a* of the hole 17. As will be described later, concerning the tapered guides 38*b*, when the pressing member 24 is assembled with respect to the housing 16, assembly thereof is carried out smoothly.

As the constituent material of the housing 16, although a hard material is preferred, assuming that appropriate rigidity can be assured, the constituent material thereof is not particularly limited. Consequently, the housing 16 can be formed by a resin material, for example. Moreover, the housing 16 may be constituted from a metal.

The seal member 18 is arranged between the tubular section 28 of the pressure sensor 12 and the tubular wall 34 of the housing 16. More specifically, the seal member 18 is arranged on an inner circumferential portion of a distal end part (an end on the side of the first opening 17*a* of the hole 17) of the tubular wall 34.

The seal member 18, for example, is an O-ring made from an elastic material such as rubber or the like. The inner circumferential surface and the outer circumferential surface of the seal member 18 are pressed in close contact respectively along the entire periphery on the outer circumferential surface of the tubular section 28 of the pressure sensor 12 and the inner circumferential surface of the tubular wall 34 of the housing 16, and in accordance therewith, an airtight (and liquidtight) seal is formed between the pressure sensor 12 and the housing 16.

The pipe joint 20 is an annular member, which is mounted on the pressure inlet port 36 of the housing 16. Non-illustrated piping through which the pressure fluid flows is connected to the pipe joint 20.

The protective member 22 is arranged on an inner side of the tubular wall 34, and between the seal member 18 and the pipe joint 20, in facing relation to the detection hole 28*a* of the pressure sensor 12. A collision preventing wall 40 is provided on a central portion of the protective member 22, for suppressing entry of moisture and dust or the like contained within the pressure fluid into the detection hole 28*a*. Plural communication holes 42, which penetrate along the axial line a, are formed around the periphery of the collision preventing wall 40.

More specifically, when pressure fluid that is introduced from the pressure inlet port 36 flows into the detection hole 28*a*, the collision preventing wall 40 is arranged on a line of extension of the axial line a of the detection hole 28*a* of the pressure sensor 12, so that the pressure fluid does not flow on a straight line from the pressure inlet port 36 to the detection hole 28*a*. Consequently, in accordance with the collision preventing wall 40, the pressure fluid that is introduced from the pressure inlet port 36 flows into the detection hole 28*a* in a bypassing manner through the communication holes 42.

Further, the protective member 22 includes a cylindrical side circumferential wall 46. The seal member 18 and the pipe joint 20 are placed in contact, respectively, with one end surface and another end surface of the side circumferential wall 46, such that the protective member 22 is sandwiched between the seal member 18 and the pipe joint 20. Moreover, the distal end of the tubular section 28 of the pressure sensor 12 enters slightly into the interior of the side circumferential wall 46.

The pressing member 24 is a plate-shaped member, which is bent in an elastically deformable manner, and is constituted, for example, from a metal material (stainless steel or the like). In the case that the pressing member 24 is constituted from a metal material, the pressing member 24 can be molded by press forming, for example. The constituent material of the pressing member 24 may be another suitable material, for example, a resin material or the like.

More specifically, the pressing member 24 includes a base section 48 that faces the seal member 18, and engagement arms 50 that extend from the base section 48, are elastically deformable, and engage with the housing 16. The base section 48 includes, in a central part thereof, a through hole 48*a* that penetrates in the thickness direction, and the tubular section 28 of the pressure sensor 12 is inserted into the through hole 48*a*. The seal member 18 abuts against the base section 48 on a peripheral portion of the through hole 48*a*.

According to the present embodiment, two engagement arms 50 project along the axial line a from edge portions on mutually opposite sides of the base section 48. The engagement arms 50 are elastic pieces, which are elastically deformable in directions (i.e., radial directions centrally about the axial line a) to approach toward and separate away from the axial line a. In a state in which the pressing member 24 is attached to the tubular wall 34, the two engagement arms 50 extend substantially in parallel.

In each of the engagement arms 50, engagement holes 52 (first engagement members) are provided that penetrate in the thickness direction of the engagement arms 50. In a state in which the pressing member 24 is attached to the tubular wall 34, the engagement projections 38 provided on the tubular wall 34 are fitted into the engagement holes 52 provided in the engagement arms 50, whereby the engagement projections 38 and the engagement holes 52 are fitted in engagement with each other. In the case of the engagement projections 38 and the engagement holes 52, movement of the pressing member 24 toward the side of the circuit board 14 is prevented.

The engagement structure of the engagement arms 50 and the tubular wall 34 is not limited to the structure shown by the exemplary illustration. For example, instead of the penetrating engagement holes 52, bottomed engagement grooves may be provided on the engagement arms 50. Further, for example, projections that project toward the side of the axial line a may be disposed on the engagement arms 50, whereas grooves in which the projections become caught may be disposed on the tubular wall 34.

Next, an assembly method for assembling the pressure switch 10 will briefly be described.

First, after the pipe joint 20 has been mounted in the pressure inlet port 36 of the housing 16, the protective member 22 is inserted into the interior of the tubular wall 34 through the opening 16*a* of the housing 16, which is not yet closed by the circuit board 14. Next, the seal member 18 is inserted inside the tubular wall 34. Consequently, on the inner side of the tubular wall 34, a state is brought about in which the protective member 22 is sandwiched between the seal member 18 and the pipe joint 20.

Next, the pressing member 24 is installed on the outer side of the tubular wall 34. More specifically, via the opening 16*a* of the housing 16, in a state in which free ends of the engagement arms 50 face toward the side of the tubular wall 34, the pressing member 24 is attached so as to cover the tubular wall 34. At this time, accompanying relative movement of the pressing member 24 along the axial line a with respect to the tubular wall 34, the engagement arms 50 are elastically deformed outwardly (in directions away from the axial line a) as a result of being pressed by the engagement projections 38, and overcome the engagement projections 38. Further, at this time, since the engagement arms 50 are urged outwardly owing to the tapering action of the tapered guides 38*b*, the engagement arms 50 overcome or pass over the engagement projections 38 smoothly.

In addition, at locations where the free ends of the engagement arms 50 have overcome the engagement projections 38, the engagement arms 50 are displaced inwardly (in directions to approach to the axial line a) by the elastic restoring forces thereof. Consequently, the engagement projections 38 are inserted into the engagement holes 52, the engagement arms 50 and the tubular wall 34 are placed in engagement, and a state is brought about in which the base section 48 is pressed against the seal member 18.

Next, by mounting of the circuit board 14, to which the pressure sensor 12 is attached, on the housing 16, the opening 16*a* of the housing 16 is closed by the circuit board 14, and the tubular section 28 of the pressure sensor 12 is inserted into the tubular wall 34 of the housing 16 in which the seal member 18 is installed. At this time, the tubular section 28 is inserted into the seal member 18 via the through hole 48*a* of the base section 48 of the pressing member 24 that is fixed to the tubular wall 34. Consequently, the interval between the pressure sensor 12 (tubular section 28) and the housing 16 (tubular wall 34) becomes sealed in an airtight (and liquidtight) manner.

In the manner described above, the pressure switch 10 is assembled as shown in FIG. 2.

Next, operations and advantages of the pressure switch 10, which is constructed in the foregoing manner, will be described.

A pressure fluid is introduced into the pressure inlet port 36 of the pressure switch 10 through non-illustrated piping that is connected to the pipe joint 20, and the pressure fluid flows into the detection hole 28*a* of the pressure sensor 12. As a result, a pressure of the pressure fluid is imposed with respect to a non-illustrated detector of the pressure sensor 12, whereupon a resistance value, which is changed by the pressure of the pressure fluid, is output to the circuit board 14, and the pressure of the pressure fluid is calculated based on the change in the resistance value. In addition, based on the calculated pressure value, an output signal is output to the exterior.

In this case, the pressure fluid avoids the collision preventing wall 40, or in other words, the pressure fluid bypasses the center region thereof that faces toward the detection hole 28*a*, and after passing through the plural communication holes 42, the pressure fluid is led into the detection hole 28*a*. Therefore, for example, in the event that moisture, dust or the like is contained within the pressure fluid, such moisture, dust or the like collides against the collision preventing wall 40, and such moisture, dust or the like is prevented from entering into the detection hole 28*a*. Thus, even in a pressure fluid containing moisture, dust or the like, deterioration in the detection accuracy by the pressure sensor 12 does not occur, and it is possible for the pressure of the pressure fluid to be detected reliably and in a stable manner.

Further, in accordance with the pressure switch 10, the pressing member 24 includes the elastically deformable engagement arms 50, and the pressing member 24 is fixed by engagement of the engagement arms 50 with respect to the housing 16. Therefore, there is no need to utilize dedicated equipment such as a caulking apparatus or the like, and it is possible to carry out assembly of the pressing member 24 onto the housing 16 easily and even with a small load. Further, when the pressing member 24 is assembled, since plastic deformation of a metallic member by way of caulking or the like is not used, a material other than metal (a resin or the like) can be applied to the housing 16, and the degree of freedom in selecting the material therefor can be enhanced. Further, since the pressing member 24 can be assembled merely by moving the pressing member 24 in one direction with respect to the housing 16, assembly thereof is facilitated.

In addition, since the sealing property is maintained even if the pressure sensor 12 moves in a vertical direction, the degree of freedom in design also is increased. Further, since the force that acts on the seal member 18 by receipt of pressure can be received by the pressing member 24 that is fixed to the tubular wall 34, loads applied to the pressure sensor 12 and the circuit board 14 (control board) can be reduced.

In particular, in the case of the present embodiment, the first engagement members (engagement holes 52) are provided on the engagement arms 50, and the second engagement members (engagement projections 38) that engage with the first engagement members are provided on the outer circumference of the tubular wall 34. In accordance with this configuration, with a simple structure, the pressing member 24 can be fixed firmly with respect to the housing 16.

Further, in the case of the present embodiment, one of the first engagement members and the second engagement members are in the form of holes or grooves, and the other of the first engagement members and the second engagement members are in the form of projections that are inserted into the holes or the grooves. In accordance with this configuration, the pressing member 24 can be fixed with an appropriate fixing force with respect to the housing 16.

Furthermore, in the case of the present embodiment, the engagement projections 38 are disposed on the outer circumference of the tubular wall 34, and on the engagement projections 38, the tapered guides 38*b* are formed in an inclined manner away from the axial line a of the hole 17, in a direction toward the side of the second opening 17*b* from the side of the first opening 17*a*. In accordance with this configuration, when the pressing member 24 is assembled with respect to the housing 16, by a tapering action of the tapered guides 38*b*, outward elastic deformation of the engagement arms 50 of the pressing member 24 is promoted, whereby the engagement arms 50 can easily overcome the engagement projections 38. Therefore, assembly of the pressing member 24 can be accomplished more easily and smoothly.

In addition, in the case of the present embodiment, the through hole 48*a* in which the portion (tubular section 28) of the pressure sensor 12 is inserted is provided in the base section 48 of the pressing member 24, and the pair of engagement arms 50 is provided on both sides of the base section 48. Therefore, the pressing member 24 can be fixed more stably with respect to the housing 16, and the functions of the pressing member 24 can be exhibited more suitably.

Figure 3:
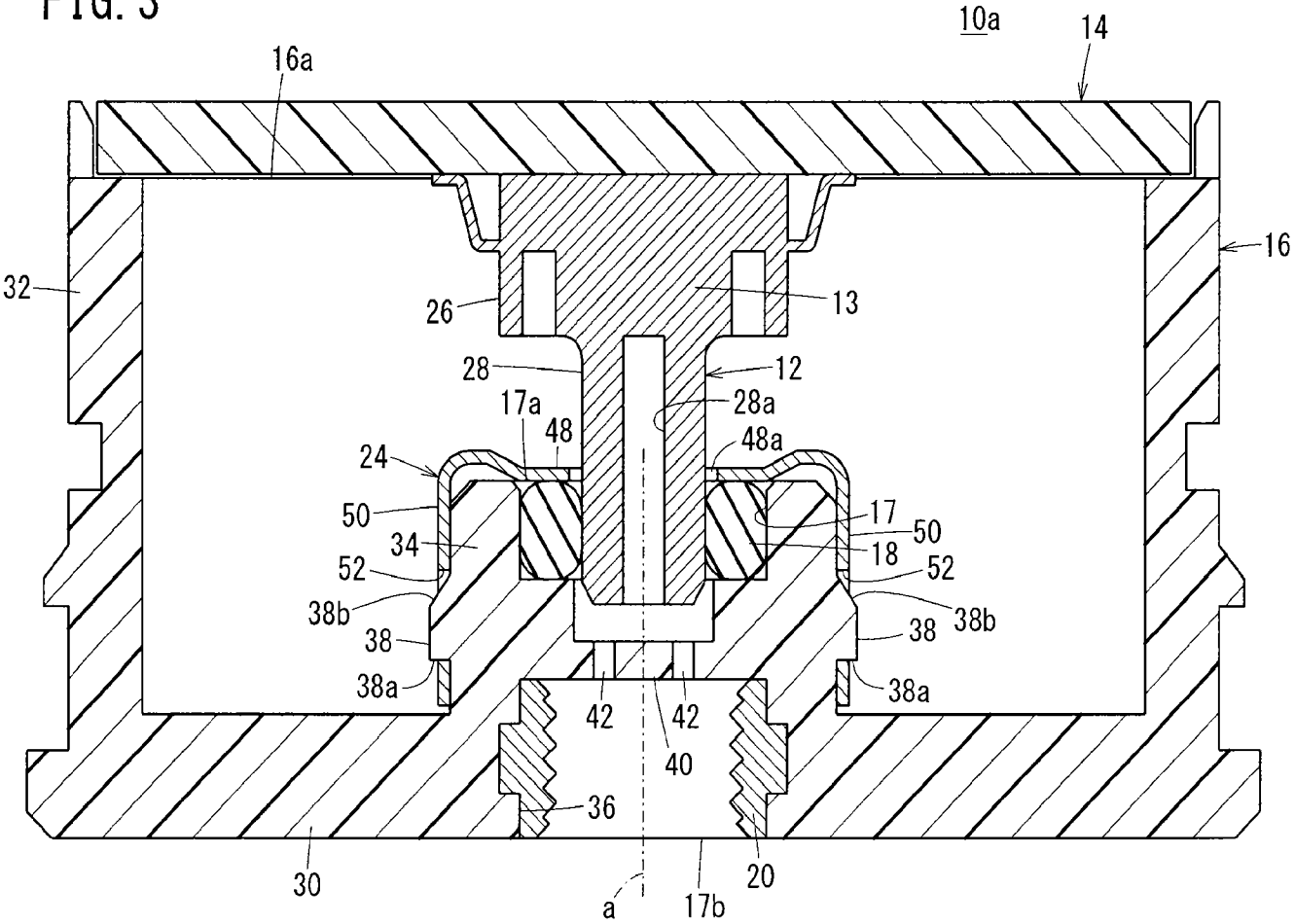
FIG. 3 is a cross-sectional view of a pressure switch according to a modification.

In the pressure switch 10, although the housing 16 and the protective member 22 including the collision preventing wall 40 are constituted as separate components, they may be formed integrally. More specifically, as with a pressure switch 10*a* according to the modification shown in FIG. 3, the collision preventing wall 40 may be formed integrally on the inner side of the tubular wall 34 of the housing 16.

The present invention is not limited to the embodiments described above, and various modifications can be adopted therein without deviating from the essential scope of the present invention. For example, in the pressure switches 10, 10*a*, the protective member 22 and the collision preventing wall 40, respectively, need not necessarily be provided.

What is claimed is:

1. A pressure switch comprising:

a pressure sensor;

a housing configured to include a hole in which a portion of the pressure sensor is inserted, and to house the pressure sensor;

an annular seal member arranged in the hole and being interposed between the pressure sensor and the housing; and a pressing member including a base section configured to face the seal member, and an elastically deformable engagement arm extending from the base section, and configured to engage with the housing, wherein:

a first engagement member is disposed on the engagement arm;

the housing includes a tubular wall configured to surround the hole;

a second engagement member is disposed on an outer circumference of the tubular wall, and configured to engage with the first engagement member;

the housing includes a bottom portion;

the tubular wall projects from the bottom portion toward the pressure sensor along an axis of the hole;

the engagement arm extends from the base section toward the bottom portion of the housing and engages with the outer circumference of the tubular wall;

the pressure sensor includes a base member; and the base section of the pressing member is arranged between the seal member and the base member of the pressure sensor.

2. The pressure switch according to claim 1, wherein:

one of the first engagement member and the second engagement member is in form of a hole or a groove; and another of the first engagement member and the second engagement member is in form of a projection that is inserted into the hole or the groove.

3. The pressure switch according to claim 1, wherein:

the hole includes in one end thereof a first opening into which the portion of the pressure sensor is inserted, and includes a second opening in another end thereof on an opposite side from the one end;

a projection is disposed on the outer circumference of the tubular wall; and on the projection, a tapered guide is formed, which is inclined so as to move away from the axis of the hole, from a side of the first opening toward a side of the second opening.

4. The pressure switch according to claim 1, wherein:

a through hole in which the portion of the pressure sensor is inserted is provided in the base section; and a pair of engagement arms is provided on both sides of the base section.

* * * * *